US006595823B2

(12) United States Patent
Huset

(10) Patent No.: US 6,595,823 B2
(45) Date of Patent: Jul. 22, 2003

(54) CIRCULAR FLYING DISK TOY

(76) Inventor: Lawrence A. Huset, 2208 State Ave., Apt. B, Costa Mesa, CA (US) 92627

( * ) Notice: Subject to any disclaimer, the term of this patent is extended or adjusted under 35 U.S.C. 154(b) by 0 days.

(21) Appl. No.: 10/261,205

(22) Filed: Sep. 30, 2002

(65) Prior Publication Data

US 2003/0027480 A1 Feb. 6, 2003

Related U.S. Application Data

(63) Continuation-in-part of application No. 09/476,259, filed on Jan. 3, 2000, and a continuation-in-part of application No. 09/932,854, filed on Aug. 17, 2001.

(51) Int. Cl.[7] ..... A63H 27/00
(52) U.S. Cl. ..... 446/46; 446/253
(58) Field of Search ..... 446/46, 47, 48, 446/253; D21/436, 441, 444, 455, 465; 473/588, 589, 590

(56) References Cited

U.S. PATENT DOCUMENTS

| | | | | | |
|---|---|---|---|---|---|
| 29,055 | A | | 7/1860 | Brown | |
| 3,158,404 | A | | 11/1964 | Noakes | |
| 3,566,532 | A | | 3/1971 | Wilson | |
| 3,590,518 | A | * | 7/1971 | LeBaron | D21/444 |
| 3,784,204 | A | | 1/1974 | Felber | |
| 4,030,472 | A | * | 6/1977 | Watkins | 446/46 |
| 4,112,612 | A | | 9/1978 | Woods | |
| 4,253,269 | A | | 3/1981 | Sullivan | |
| 4,329,807 | A | * | 5/1982 | Atkinson | 446/46 |
| 4,356,660 | A | | 11/1982 | O'Brien | |
| 4,940,441 | A | | 7/1990 | Novinsky | |
| 4,986,790 | A | | 1/1991 | Boury | |
| D324,114 | S | * | 2/1992 | Batrick et al. | D21/444 |
| D326,121 | S | * | 5/1992 | Asner | D21/443 |
| 5,127,390 | A | | 7/1992 | Paulson | |
| D354,525 | S | * | 1/1995 | Sullivan | D21/443 |
| 5,476,405 | A | * | 12/1995 | Clayborne | 446/46 |
| 5,512,028 | A | | 4/1996 | Sparks, III | |
| 5,630,742 | A | * | 5/1997 | Honaker | 446/46 |
| 5,816,965 | A | | 10/1998 | Kotler | |
| 6,113,453 | A | * | 9/2000 | Stuffelbeam | 446/46 |

* cited by examiner

*Primary Examiner*—Derris H. Banks
*Assistant Examiner*—Urszula M Cegielnik

(57) ABSTRACT

A flying disk toy includes a cylindrical outer rim and a flat circular center airfoil within the rim. The centerline of the edge of the airfoil is positioned to bisect the side surface of the rim, resulting in a flying disk toy of increased stability and throwing ease. The cylindrical outer rim is preferably made from a soft pliable material such as foam or rubber. A cord, preferably of elastic material, is tethered to the symmetrical center of the circular airfoil.

39 Claims, 6 Drawing Sheets

CIRCULAR FLYING DISK TOY

CROSS REFERENCE TO RELATED APPLICATION

This application is a continuation-in-part of application Ser. No. 09/476,259, filed on Jan. 3, 2000 for Circular Flying Disk Toy, and a continuation-in-part of application Ser. No. 09/932,854 filed Aug. 17, 2001 for Circular Flying Disk Toy.

BACKGROUND OF THE INVENTION

1. Field of the Invention

The subject invention relates generally to toys and amusement devices and more particularly to an aerodynamic disk consisting of a circular center airfoil within a cylindrical outer rim.

2. Description of the Related Art

Flying saucer devices, or so-called "frisbees", are known in the prior art. Such devices have been used as throwing implements or toys, typically in games of "catch". Such devices typically employ a central disk portion and a rim extending downwardly from and circumscribing the central disk, for example, as disclosed in U.S. Pat. No. 3,359,678.

SUMMARY OF THE INVENTION

The present invention provides a flying disk toy including a cylindrical outer rim having a circular top edge running parallel to a circular bottom edge. A flat circular central airfoil having a circular edge is attached to the inner circumference of the cylindrical outer rim such that the vertical height of the cylindrical outer rim extends beyond the circular edge of the central airfoil in opposite directions by equal amounts. The circular central airfoil may have a small aperture at its symmetrical center through which a cord of elastic or inelastic material is passed and tethered to the airfoil by a knot, preferably through a spherical bead. The cylindrical outer rim is preferably made out of a soft, pliable light-weight material such as foam or rubber, for example. When thrown, the flying disk provides increased gyroscopic effect and stability and the soft cylindrical outer rim eliminates impact injuries to players or bystanders. The cord tethered to the flying disk toy may be used for catching, throwing, holding, or moving the disk about while it is spinning.

BRIEF DESCRIPTION OF THE DRAWINGS

The just summarized invention will now be described in detail in conjunction with the drawings of which.

DETAILED DESCRIPTION

Figure 1:
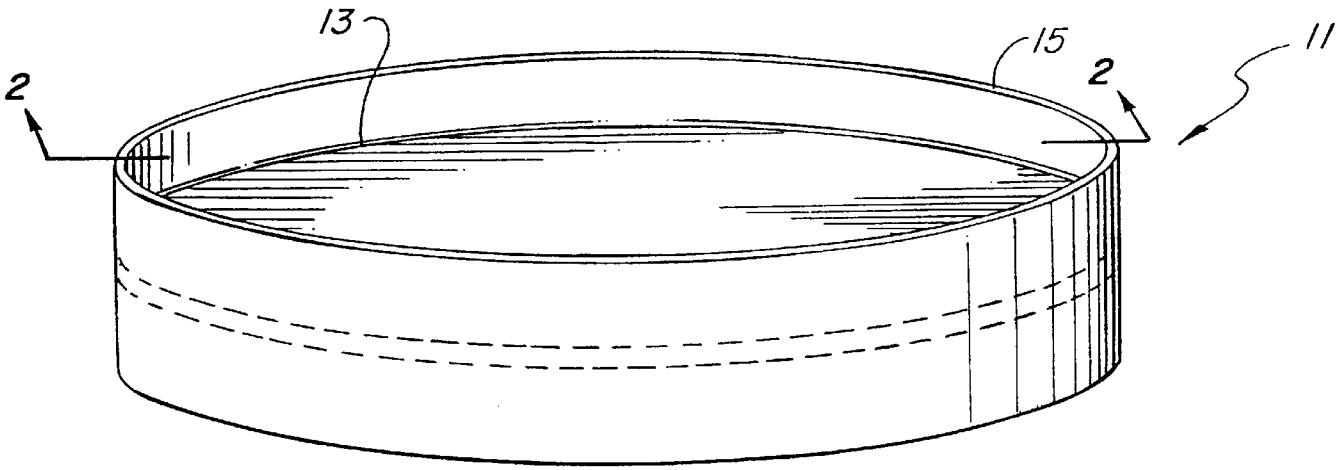
FIG. 1 is a perspective view of a first embodiment of the invention.
Figure 2:
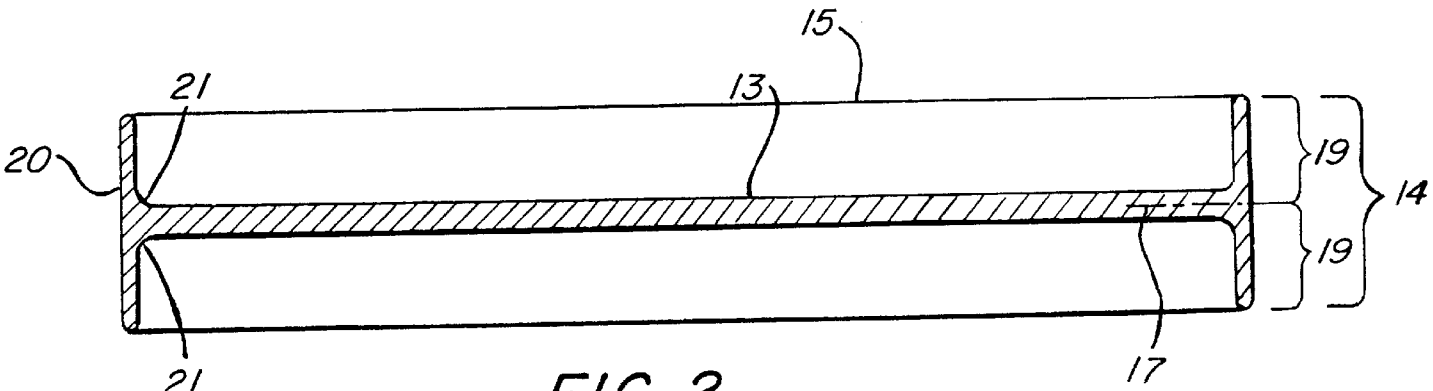
FIG. 2 is a sectional view taken at 2—2 of FIG. 1.

A flying disk toy 11 according to a first preferred embodiment is shown in FIGS. 1 and 2. The center circular portion or airfoil 13 of this disk toy 11 is planar and continuous. It may be constructed of a plastic foam board, plastic, or rubber, or any other equivalent light-weight material and can vary in diameter between 5 inches to 12 inches. The outer rim 15 is cylindrical and may be comprised of the same material as the airfoil 13, or any other equivalent light-weight material, and may vary in height from 1 inches to 2 inches.

The cylindrical outer rim 15 is positioned around the airfoil 13 and attached at a 90 degree angle with a glue gun or other adhesive if the rim 15 and airfoil 13 are separate different materials. In the alternative, the outer rim and airfoil are molded as one piece out of the same material, or different materials. The outer rim 15 is attached to the center airfoil 13 such that the center line 17 of the edge of the center airfoil 13 bisects the side surface 20 of the cylindrical outer rim 15 so that equal portions 19 of the side surface 20 extend to each side of center line 17.

For a 10 inch diameter disk, the side portions 19 may each be ¾ inches for a total height of 1½ inches. As a result, the top and bottom of the flying disk toy 11 are mirror images of one another. It has been found that, depending on the material used, the height of the cylindrical outer rim can vary between ¾ to 2 inches.

After the cylindrical outer rim 15 is attached to the airfoil 13, silicone may be applied over the perimeter of seams 21, or "equatorial line," where the outer rim 15 connects to the circular center airfoil 13. The silicone is smoothed evenly around the entire circumference on both sides so that both sides have a smoothed layer of silicone where the airfoil 13 and outer rim 15 connect. This treatment increases the circumferential weight at the outer rim 15, increasing the gyroscopic effect tending to level the disk in flight. Any other suitable weight material may be used. This becomes more important when the cylindrical outer rim 15 is made out of a light-weight soft, flexible or pliable material, such as foam or soft rubber, for example.

A soft flexible material for the cylindrical outer rim is most beneficial for flying toys meant for smaller children in order to eliminate impact injuries. The use of soft light-weight and pliable materials, like foam, for the cylindrical outer rim 15, requires thicknesses for the cylindrical outer rim that are greater than the thickness of the circular center airfoil 13. The circular center airfoil is preferably made of plastic or a stiffer rubber material. The cylindrical outer rim could be up to about four times the thickness of the circular center airfoil, depending on the weight of the material utilized for the cylindrical outer rim.

Figure 5:
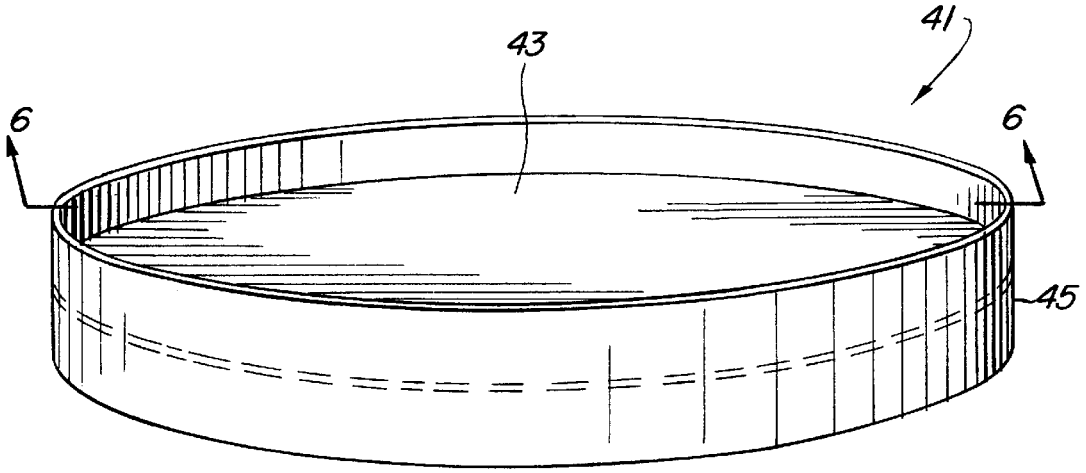
FIG. 5 is a perspective view of a third preferred embodiment.
Figure 6:
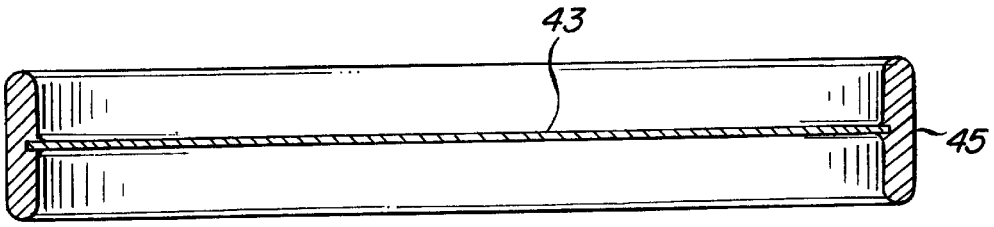
FIG. 6 is a sectional view taken at 6—6 of FIG. 5.

FIGS. 5 and 6 illustrate a flying toy 41 which uses a soft pliable material for the outer rim 45 such as foam or a flexible rubber, for example. The circular center airfoil 43 is preferably made of plastic material. The ratio of thickness of the circular center airfoil and the cylindrical outer rim can vary from 1:1 to 1:4. Preferred ranges of actual thickness for the circular center airfoil are 1/32 to ¼ inches. Preferred ranges of actual thickness for the cylindrical outer rim are 1/16 to ½ inches.

The greater thickness of the cylindrical outer rim makes up for the light weight, less dense, foam material, such as polyurethane, for example, that may be used for the outer rim.

Figure 7:
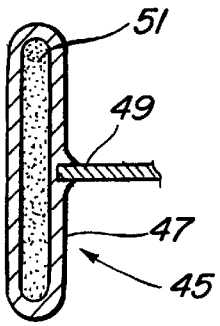
FIG. 7 is a sectional view of an alternative embodiment of the cylindrical outer rim.
Figure 8:
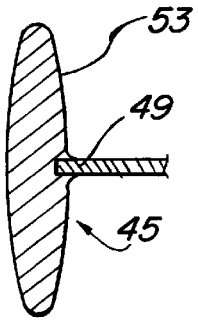
FIG. 8 is a sectional view of another preferred embodiment of the cylindrical outer rim.

FIG. 7 illustrates in cross-section the construction of a certain type of soft and pliable cylindrical outer rim 45 that could be used. The outer rim 45 includes a casing 47 of flexible rubber which encloses a foam material 51. The outer rim 45 is attached to the circular center airfoil 43 at a slot 49 formed by methods well known, such as by adhesion, as press-fit, for example, in the rubber casing 47. It is also contemplated that the rubber casing may simply contain air rather than foam 51. Alternatively, the cylindrical outer rim 45 could be made from a solid foam material 53 without any casing, as shown in FIG. 8. Depending on the weight of the material used, the thickness of the cylindrical outer rim 45 could be up to 4 inches or more.

The height of the rim 15 (FIG. 1) in relation to the diameter of the airfoil 13 determines distance performance. Thus, for example, with an airfoil diameter of 8 inches, use of a vertical rim height 14 (FIG. 2) of 1½ inches results in substantially more air resistance than a vertical rim height of 1¼ inches. A ratio of diameter versus height of rim could vary from a ratio of 5:1 to a ratio of 10:1 without significantly affecting performance. Only the distance of flight is affected by this ratio. Greater height of the outer vertical rim results in more air caught between the airfoil and the outer rim, thus resulting in a more pronounced floating effect. A ratio of diameter to rim height greater than 10 to 1 has been found to result in instability of flight causing the flying disk to veer to the right or left.

The overall weight and weight ratio of circular center airfoil to cylindrical outer rim also affects performance. The preferred overall weight of a nine inch diameter toy has been determined to be about 100 grams. The maximum weight preferably does not exceed 5 oz. or 140 grams. The weight of the cylindrical outer rim is preferably about the same weight of the circular center airfoil and could vary up and down by about a factor of ⅓. The preferred weight of a 100 gram flying toy is a 50 gram circular center airfoil and a 50 gram cylindrical outer rim.

Figure 3:
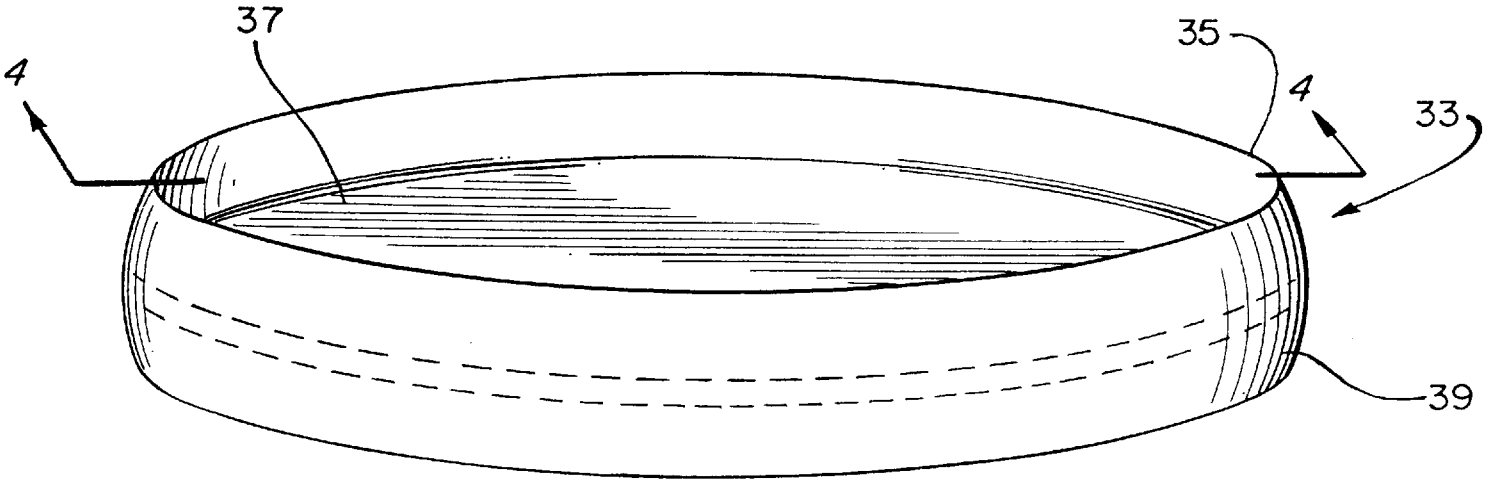
FIG. 3 is a perspective view of a second embodiment.
Figure 4:
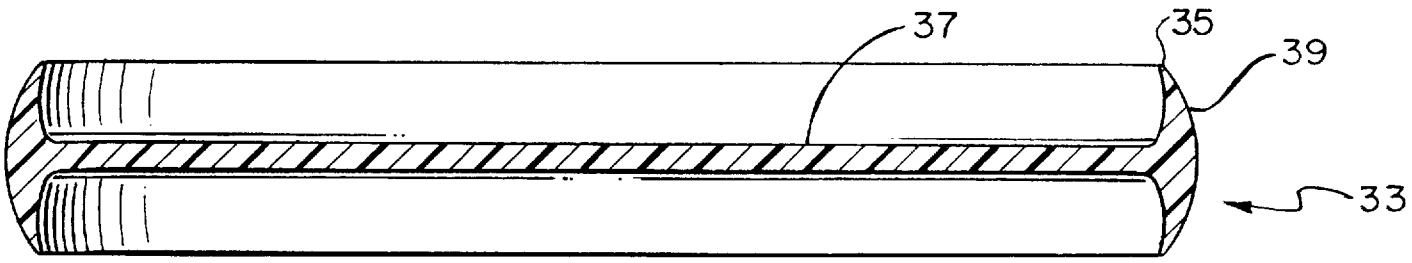
FIG. 4 is a sectional view taken at 3—3 of FIG. 3.

For high production purposes, the flying disk 33 (FIGS. 3 and 4) is preferably fabricated by a plastic injection molding process. The result is a molded plastic body including a flat circular airfoil 37 bounded about its perimeter by a cylindrical rim portion 35 extending an equal distance on each side of the center airfoil 37. Any moldable material may be used, such as foam, plastic, or rubber, for example. The cylindrical rim portion 35 is at a 90 degree angle to the airfoil 37 for the entire circumference of the center airfoil. The outer surface 39 of the cylindrical rim portion 35 may curve upwardly and downwardly from the center airfoil 37.

The flying disk 33 is thus shaped to provide a body having an aerodynamic profile, such that when it is flung through the air with a spinning motion, it appears to sail, or "float," through the air. The spinning motion imparted by a wrist-flick gyroscopically stabilizes the flight.

Flying disks such as those shown in FIGS. 1–6 may be thrown by the user in a backhanded motion with one hand, keeping the arm parallel with the ground, and ending the throw with a snapping motion of the wrist. Variations of the angle of the arm at launch determine the angle of flight relative to altitude and direction.

The flying disks 11, 33, and 41 are easier to throw and catch due to their shape, levelness, and the effect of "floating" toward the receiving individual, rather than being "whipped" toward that individual. Children adapt to the flying toy more quickly and easily, due to the steadiness of the flight and the ability to toss the flying disk along a more level path and at a shorter range. This flying disk can also be thrown in areas that previously did not lend themselves to this activity because the disks can be comfortably thrown at a closer range than those of the prior art, which is especially important in densely populated areas. Thus, a large playing field is unnecessary. The flying disk of this invention can be comfortably used in an average-sized yard. It is also impossible for the flying disk to be upside-down when thrown since both the top and the bottom are identical.

Figure 9:
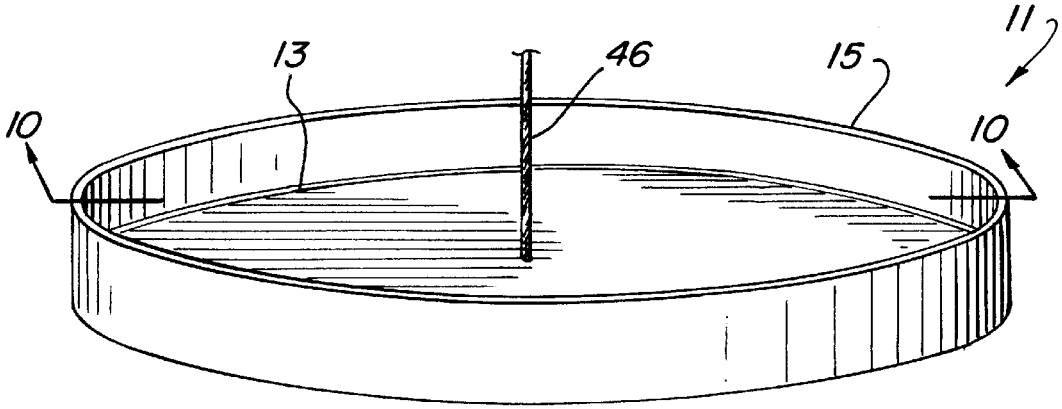
FIG. 9 is a perspective view of another preferred embodiment of the invention.
Figure 10:
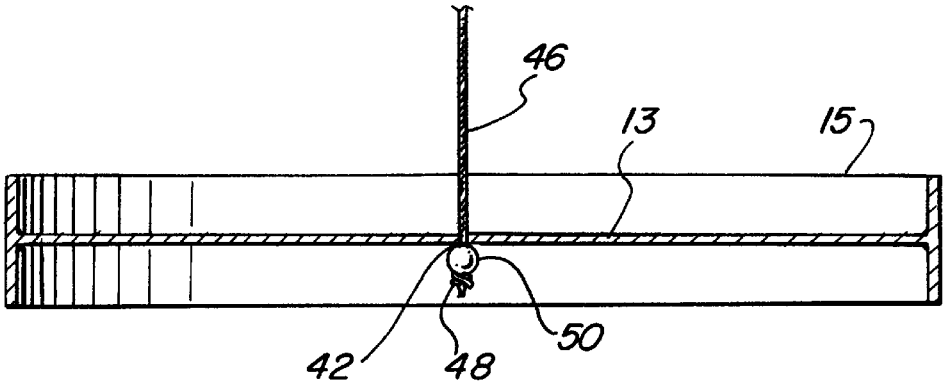
FIG. 10 is a sectional view taken along 10—10 of FIG. 9.

Enjoyment of the flying disk toy 11 is enhanced by adding a cord 46 (FIG. 9) that is attached to the symmetrical center of the airfoil 13. The cord 46 may be an elastic bungee-type cord or a non-elastic strap or strip of plastic or string strong enough to withstand the forces exerted on it during play. The cord 46 is preferably 1/16 inch to ⅛ inch wide and 12 to 60 inches long.

The cord 46 is attached to the airfoil 13 by any one of a number of ways. A small aperture 42 may be placed in the airfoil at its symmetrical center. The aperture should be no larger than an ⅛ inch in diameter and preferably only large enough to allow the cord 46 to pass through. A spherical bead 50 of glass, steel, or plastic, or equivalent material, with a hole through its center is threaded onto the cord 46 and placed at one end where it is held by a knot 48, bulge, or equivalent. The other end of the cord 46 is threaded through the aperture 42 in the airfoil 13. The bottom side of airfoil 13 then rests on the bead 50. When the flying disk toy is spinning while being held by the cord 46, it rotates around the cord 46 on the bead 50, with the bead 50 acting as a relatively frictionless bearing.

Figure 11:
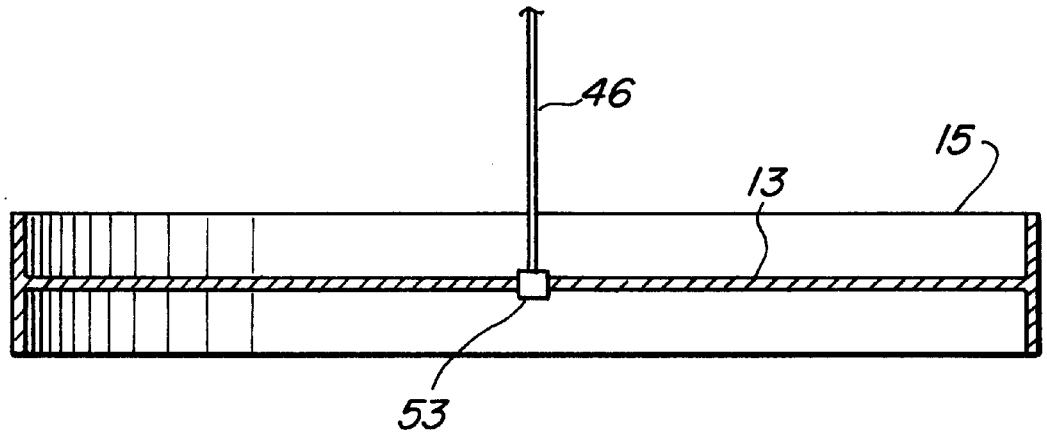
FIG. 11 is a sectional view taken along 10—10 of FIG. 9 showing an alternate attachment method for the cord.

The cord 46 may alternatively be attached to the airfoil 13 by a swivel attachment 53 (FIG. 11) that is placed at the symmetrical center of the airfoil 13.

Figure 13:
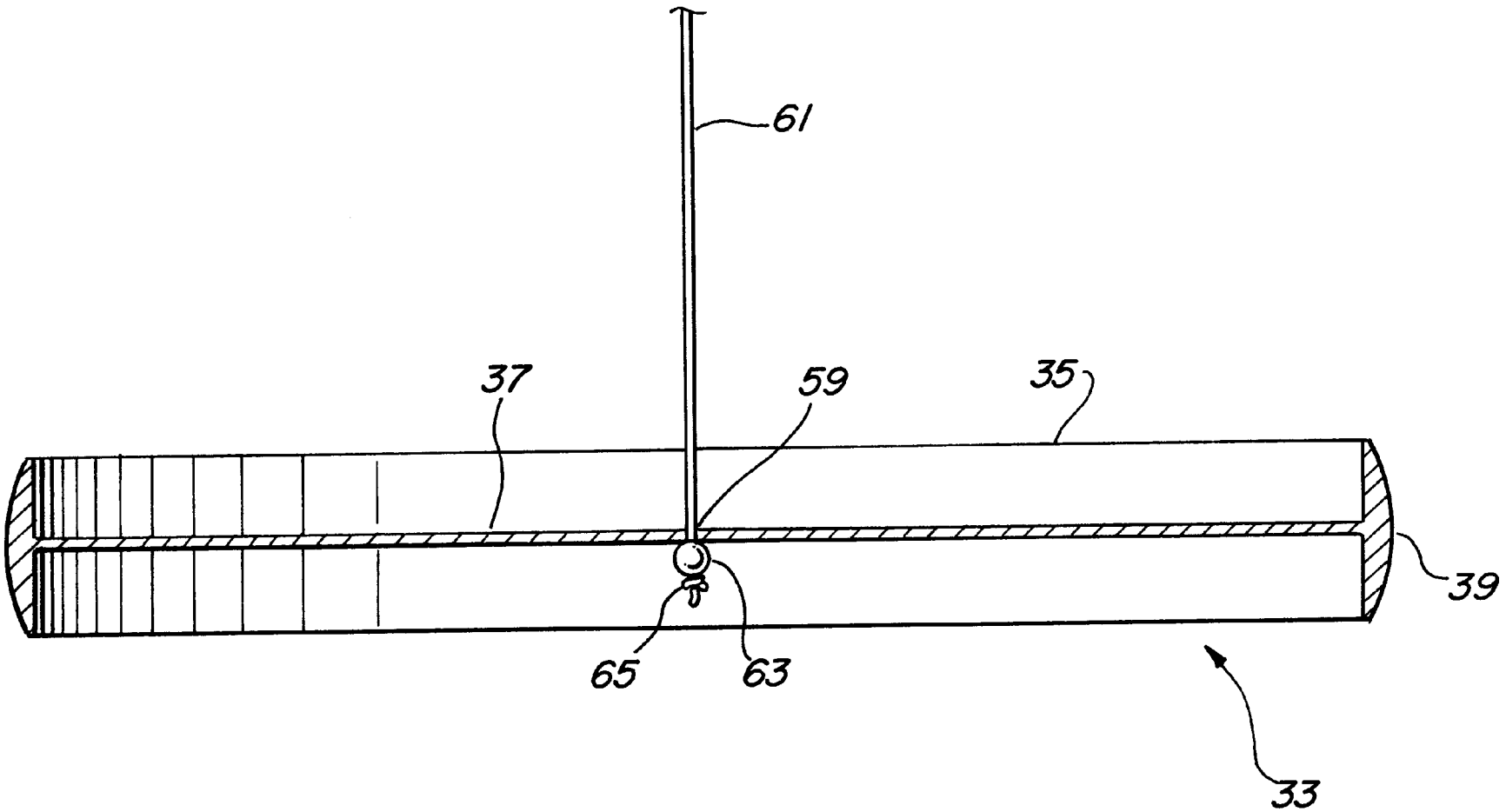
FIG. 13 is a sectional view of the embodiment of FIGS. 3 and 4 with a cord tether.

The flying disk toy 33 (FIGS. 3 and 4) with a curved outer surface 39 on its outer rim 35, also may have an aperture 59 in the airfoil at its symmetrical center (FIG. 13). A spherical bead 63 held between a stop 65 and the bottom of the airfoil 37 acts as a bearing surface for the rotation of the disk 33 about its cord 61.

In use, the cord 61 is held by one hand while the other hand is used to start the disk spinning. The disk will continue to spin on its axis maintaining its orientation with the play surface while it is propelled back and forth, up and down and around, by manipulation of the cord 61. When the cord 61 is attached to a long pole, the flying disk can be manipulated high in the air with hovering and darting movements that resemble a flying saucer. In this manner, the flying disk toy can be used and enjoyed by a single individual. The flying disk toy with elastic cord can thus be used as a hybrid, gyroscopic spinning yo-yo.

When multiple users are involved in multiple user-play, the disk may be thrown and then caught by its cord. When so caught, the disk continues to spin and glide from the force of the spinning thrust until its inertia is negated by the capture of the elastic cord. When captured, its path comes to a mild stop and begins to move in the opposite direction, as the disk continues to maintain rotation on its axis.

Figure 12:
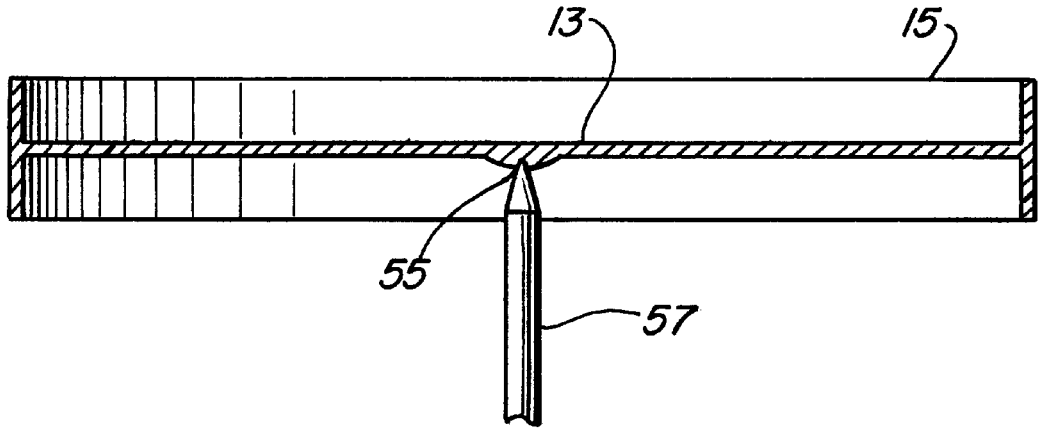
FIG. 12 is a sectional view of an alternate embodiment.

In an alternate embodiment shown in FIG. 12, a flying disk toy is shown wherein the airfoil 13 has an indentation 55 at its symmetrical center to permit the disk to rotate and spin on a pointed object 57, like a pen or pencil, for example.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A flying disk toy for throwing through the air comprising:

a circular center airfoil having a fixed diameter, an outer edge, a top surface, and a bottom surface, the top surface being planar, the bottom surface being planar and spaced apart from the top surface by a fixed distance; and a cylindrical outer rim made from a soft pliable material having a diameter equal to the diameter of the circular center airfoil and fastened to the circular center airfoil at the outer edge of the circular center airfoil, the cylindrical outer rim having a vertical height that extends beyond the top surface and bottom surface of the circular center airfoil;

whereby when thrown, the flying toy appears to move through the air with a floating motion.

2. The flying toy of claim 1 wherein the outer rim has a curved outer side surface.

3. The flying toy of claim 1 further including weighting means for increasing the weight of the flying toy at the intersection of the airfoil and the rim.

4. The flying toy of claim 1 wherein the circular center airfoil and cylindrical outer rim are formed as a single part.

5. The flying toy of claim 1 wherein the circular center airfoil is a solid plastic.

6. The flying toy of claim 1 wherein the diameter of the circular center airfoil is within the range of five inches to twelve inches, inclusive.

7. The flying toy of claim 1 wherein the vertical height of the outer rim is within the range of one inch to two inches, inclusive.

8. The flying toy of claim 1 wherein the ratio of circular center airfoil diameter to vertical height of the cylindrical outer rim is within the range of 5:1 to 10:1.

9. The flying toy of claim 1 wherein the cylindrical outer rim has a thickness that is greater than the distance between the top and bottom surface of the circular center airfoil.

10. The flying toy of claim 1 wherein the thickness of the cylindrical outer rim has a 4:1 ratio with the distance between the top and bottom surface of the circular center airfoil.

11. The flying toy of claim 1 wherein the distance between the top and bottom surface of the circular center airfoil varies between about 1/32 to 1/4 inches.

12. The flying toy of claim 1 wherein the thickness of the cylindrical outer rim varies between about 1/16 to 1/2 inches.

13. A flying disk toy for throwing through the air, comprising:

a circular center airfoil having a diameter in the range of 5 inches to 12 inches, inclusive, an outer edge, a top surface, and a bottom surface, the top surface being planar, the bottom surface being planar and spaced apart from the top surface by a fixed distance;

a cylindrical outer rim made from a soft pliable material having a diameter equal to the diameter of the circular center airfoil and fastened to the outer edge of the circular center airfoil, the cylindrical outer rim having a vertical height that extends beyond the top surface and the bottom surface of the circular center airfoil.

14. The flying toy of claim 13 wherein the outer rim has a curved outer side surface.

15. The flying toy of claim 13 further including weighting means for increasing the weight of the toy at the intersection of the airfoil and the rim.

16. The flying toy of claim 13 wherein the circular center airfoil and cylindrical outer rim are formed as a single part.

17. The flying toy of claim 13 wherein the circular center airfoil is a solid member.

18. The flying toy of claim 13 wherein the vertical height of the outer rim is within the range of one inch to two inches, inclusive.

19. The flying toy of claim 13 wherein the cylindrical outer rim has a thickness that is greater than the distance between the top and bottom surface of the circular center airfoil.

20. The flying toy of claim 13 wherein the cylindrical outer rim has a thickness that is a 4:1 ratio with the distance between the top and bottom surface of the circular center airfoil.

21. The flying toy of claim 13 wherein the ratio of circular center airfoil diameter to vertical height of the cylindrical outer rim is within the range of 5:1 to 10:1.

22. The flying toy of claim 13 wherein the distance between the top and bottom surface of the circular center airfoil varies between about 1/32 to 1/4 inches.

23. The flying toy of claim 13 wherein the thickness of the cylindrical outer rim various between about 1/16 to 1/2 inches.

24. A flying toy for throwing through the air, comprising:

a circular center airfoil having a fixed diameter, an outer edge, a top surface, and a bottom surface, the top surface being planar, continuous and flat, the bottom surface being planar, continuous and flat and spaced apart from the top surface by a fixed distance; and a cylindrical outer rim having a diameter equal to the diameter of the circular airfoil and fastened to the circular center airfoil at its outer edge, the cylindrical outer rim having a vertical height that extends beyond the top surface and bottom surface of the circular airfoil by equal amounts;

whereby when tossed with a spinning motion the flying toy appears to move through the air with a floating motion.

25. The flying toy of claim 24 wherein the outer rim has a curved outer side surface.

26. The flying toy of claim 24 further including weighting means for increasing the weight of the toy at the intersection of the airfoil and the rim.

27. The flying toy of claim 24 wherein the circular center airfoil includes an indentation at its center.

28. The flying toy of claim 24 wherein the circular center airfoil is solid plastic.

29. The flying toy of claim 24 wherein the diameter of the circular center airfoil is within the range of five inches to twelve inches, inclusive.

30. The flying toy of claim 24 wherein the vertical height of the cylindrical outer rim is within the range of one inch to two inches, inclusive.

31. The flying toy of claim 24 wherein the ratio of circular center airfoil diameter to vertical height of the cylindrical outer rim is within the range of 5:1 to 10:1.

32. The flying toy of claim 24 further comprising a cord attached to the symmetrical center of the circular center airfoil.

33. The flying toy of claim 25 wherein the cord is an elastic cord.

34. The flying toy of claim 24 wherein the circular center airfoil includes an aperture through its symmetrical center; and further comprising a cord attached to the circular airfoil by passing through the aperture in the airfoil.

35. The flying toy of claim 34 further comprising a knot at one end of the cord resting against one surface of the circular center airfoil.

36. The flying toy of claim 35 further comprising a bead with an aperture therethrough, the cord passing through the aperture in the bead and the aperture in the circular center airfoil, whereby the bead provides a bearing surface for rotation of the airfoil about the cord.

37. The flying toy of claim 24 wherein the overall weight of the flying toy does not exceed about 5 ounces.

38. The flying toy of claim 37 wherein the weight of the cylindrical outer rim is at about two-thirds the weight of the circular center airfoil.

39. The flying toy of claim 24 wherein the overall weight of the flying toy is about 100 grams.

* * * * *